US006851821B2

(12) United States Patent
Hsu

(10) Patent No.: US 6,851,821 B2
(45) Date of Patent: Feb. 8, 2005

(54) ANNEX LIGHTING FIXTURE FOR DECORATIVE CEILING FAN

(76) Inventor: Nien-Fu Hsu, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/442,239

(22) Filed: May 21, 2003

(65) Prior Publication Data

US 2004/0233660 A1 Nov. 25, 2004

(51) Int. Cl.[7] ..... F21V 33/00
(52) U.S. Cl. ..... 362/96; 362/294; 362/363
(58) Field of Search ..... 362/363, 96, 147, 362/263, 294, 362, 404; 416/5

(56) References Cited

U.S. PATENT DOCUMENTS 2,022,264 A * 11/1935 Wiedenhoeft ..... 362/362
5,028,206 A * 7/1991 Kendregan et al. ..... 416/5
5,404,284 A * 4/1995 Davis, Jr. ..... 362/294
5,440,459 A * 8/1995 Chan ..... 362/96
6,494,589 B1 * 12/2002 Shyu ..... 362/96

* cited by examiner

*Primary Examiner*—Y. My Quach-Lee
(74) *Attorney, Agent, or Firm*—Troxell Law Office PLLC

(57) ABSTRACT

An annex lighting fixture for decorative ceiling fan in which a complement of self-rigging lighting fixture and optional choices of neon tubes can be changed to accommodate the environment or the occasion. The invention includes a ceiling fan and a light fixture where underneath the ceiling fan is a seat body on which a removable light fixture is installed. Inside the light fixture a fixture base with hollow conduit is disposed through the center and a plurality of neon tubes. Encompassing the fixture base is a shell case made up by a plurality of upper and lower shells while underneath the fixture base is a sectional switch that controls the number and the type of neon tubes to be lighted, further enhancing the versatility and functionality of the invention.

5 Claims, 6 Drawing Sheets

ANNEX LIGHTING FIXTURE FOR DECORATIVE CEILING FAN

BACKGROUND OF THE INVENTION

1) Field of the Invention

The invention relates to an improvement to the annex lighting fixture for decorative ceiling fan, specifically the type of annex lighting fixture installed underneath the decorative ceiling fan that can be self-rigged with a wide variety of outward appearances and internal neon tube arrangements.

2) Description of the Prior Art

Referring to FIG. 1 a perspective view of a conventional annex lighting fixture for a decorative ceiling fan, wherein a light fixture (A) with fixture base (A1) is installed underneath the decorative ceiling fan (B) where centrally underneath the fixture base (A1) is a pull string to control the illumination of light fixture (A). In a conventional model the light fixture (A), the fixture base (A1) and a light bulb inside of the light fixture (A) underneath the ceiling fan (B) constitute one unchangeable, inseparable entity where pulling strings with different settings changes only applying to light intensity but not the light color or the outward appearance of light fixture (A). Also the ceiling fan (B), the light fixture (A) and the fixture base (A1) constitute an enclosed, unchangeable entity that can not render different effects to accommodate the atmosphere within a space short of changing the entire fixture. The conventional annex light fixture (A) is a simple, closed structure that uses a designated light bulb that has limited flexibility. In addition, the light fixture (A), not of a self-rigging design, affects no flexibility in real application. All these characteristics and limits of the conventional lighting fixture call for an improvement in terms of versatility and flexibility.

SUMMARY OF THE INVENTION

The invention herein provides different possibility in terms of appearances and illumination arrangements; it is no longer a fixture of a single given shape with pull string controls only applying to light intensity. The present invention devises a light fixture seat underneath a ceiling fan, whereupon, by means of various screw types and screw holes positioning on a light fixture frame; different shell elements, colors and finishes can be exploited to give a rich variety of outward appearances on self-rigging basis. In addition, the various lighting arrangements within the fixture are controlled by the sectional switches underneath for different effects. The rich choices of fixture selections, shell types, composition styles, glazing finishes are all open for selection and change; thereby offering great versatility to the user.

It is the primary goal of the present invention to affect an improvement to the conventional annex lighting fixture for decorative ceiling fan where the lighting fixture and the neon tubes therein, all have the option of self-rigging installation or changes to achieve the different effects to accommodate the environment or occasion.

A secondary consideration of the invention herein is to offer the clear finish or sand blasted finish shell as basic choices for the self 10 rigging assembly set.

BRIEF DESCRIPTION OF THE DRAWINGS

To enable a further understanding of the objectives and the technological methods of the invention herein, the brief description of the drawings below is followed by the detailed description of the preferred embodiments.

DETAILED DESCRIPTION OF THE PREFERRED EMBODIMENT

Figure 1:
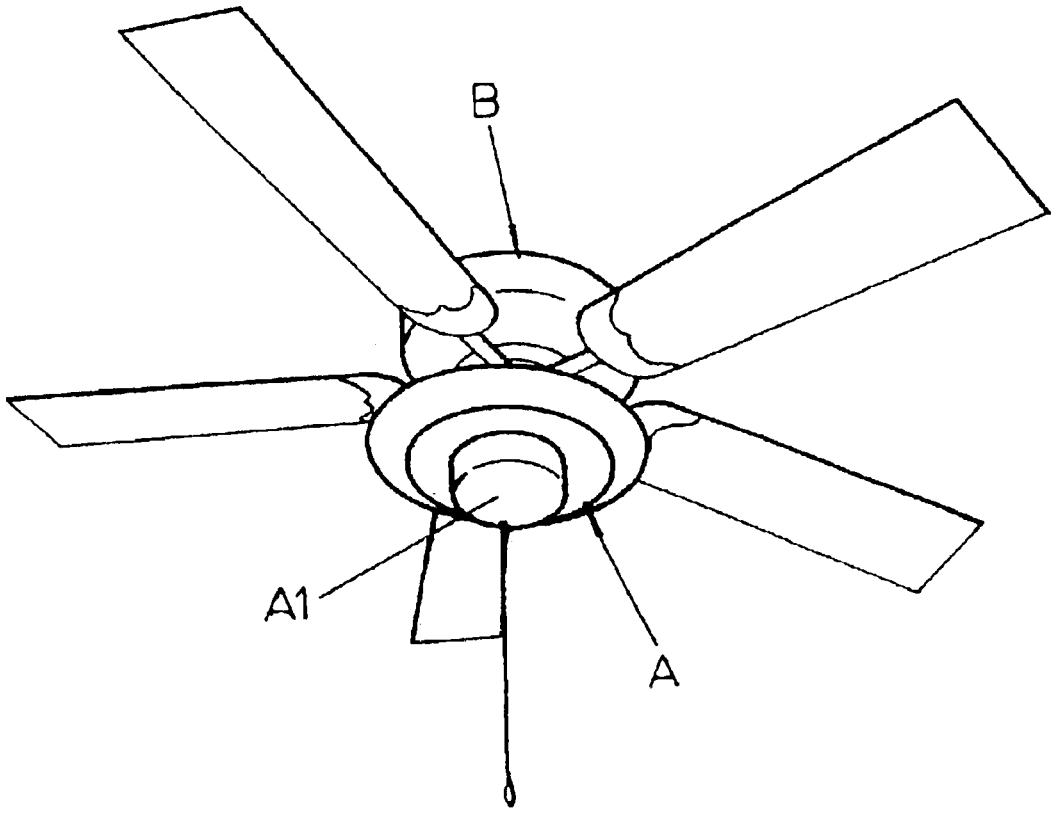
FIG. 1 Prior Art
FIG. 1 is a perspective view of the conventional annex lighting fixture applied to decorative ceiling fans.
Figure 2:
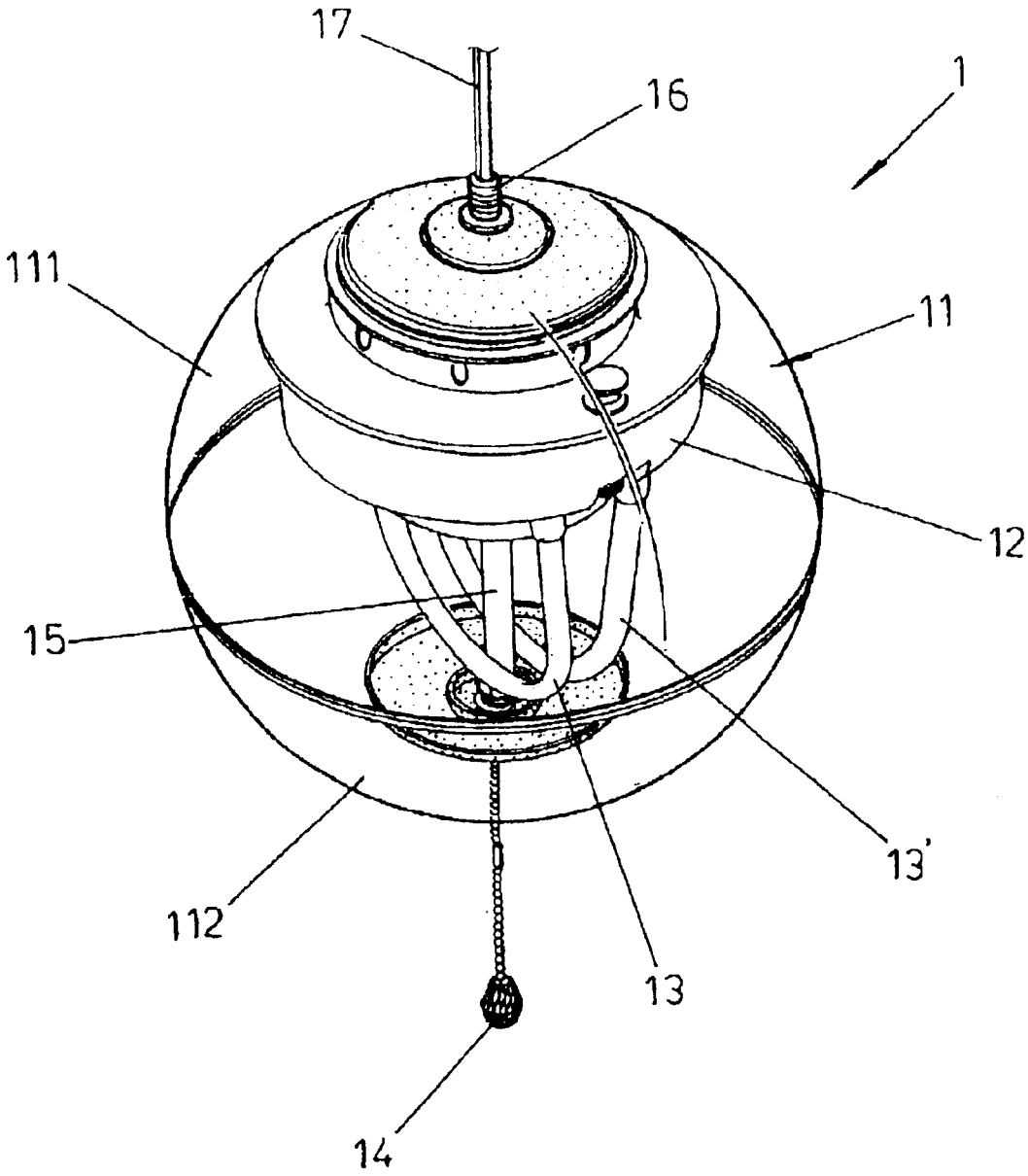
FIG. 2 is an enlarged perspective view of the annex lighting fixture according to the present invention.
Figure 3:
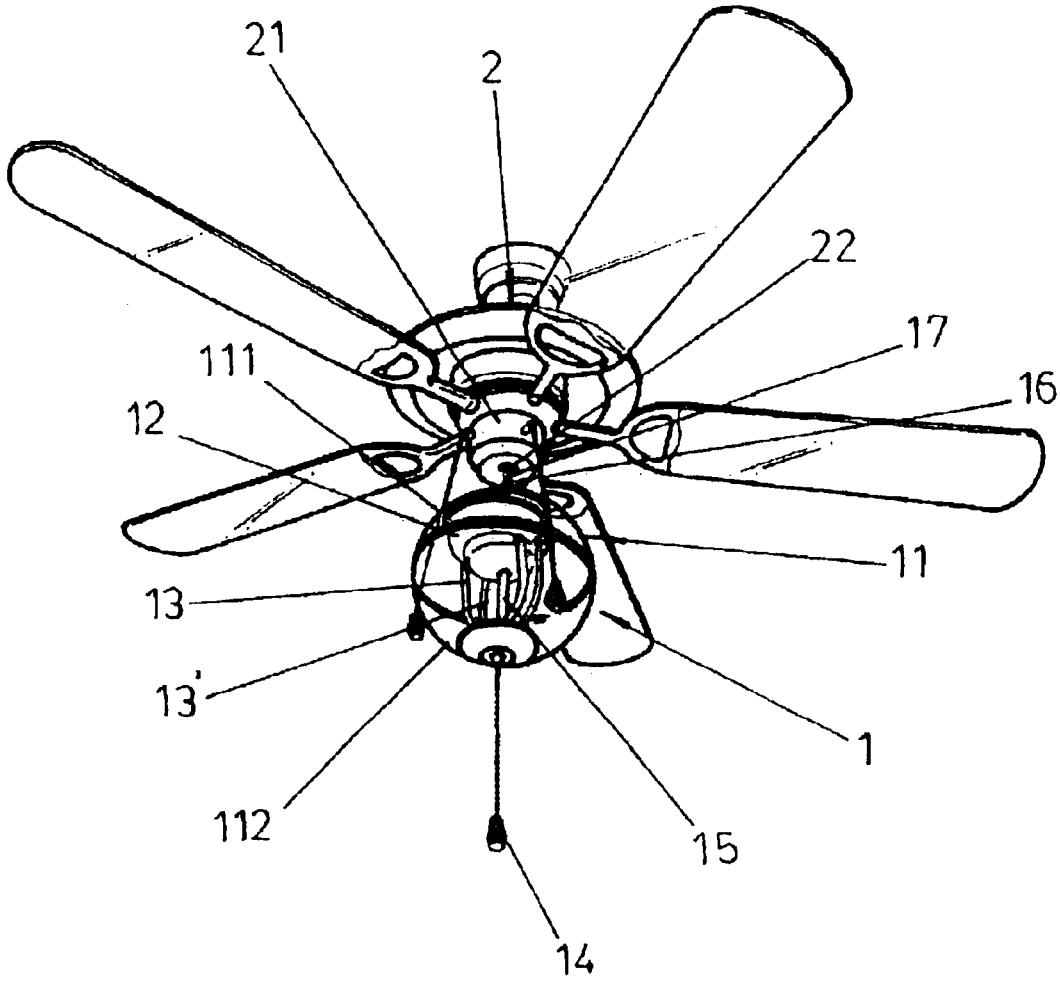
FIG. 3 is an perspective view of the decorative ceiling fan with the annex lighting fixture according to the present invention.
Figure 4:
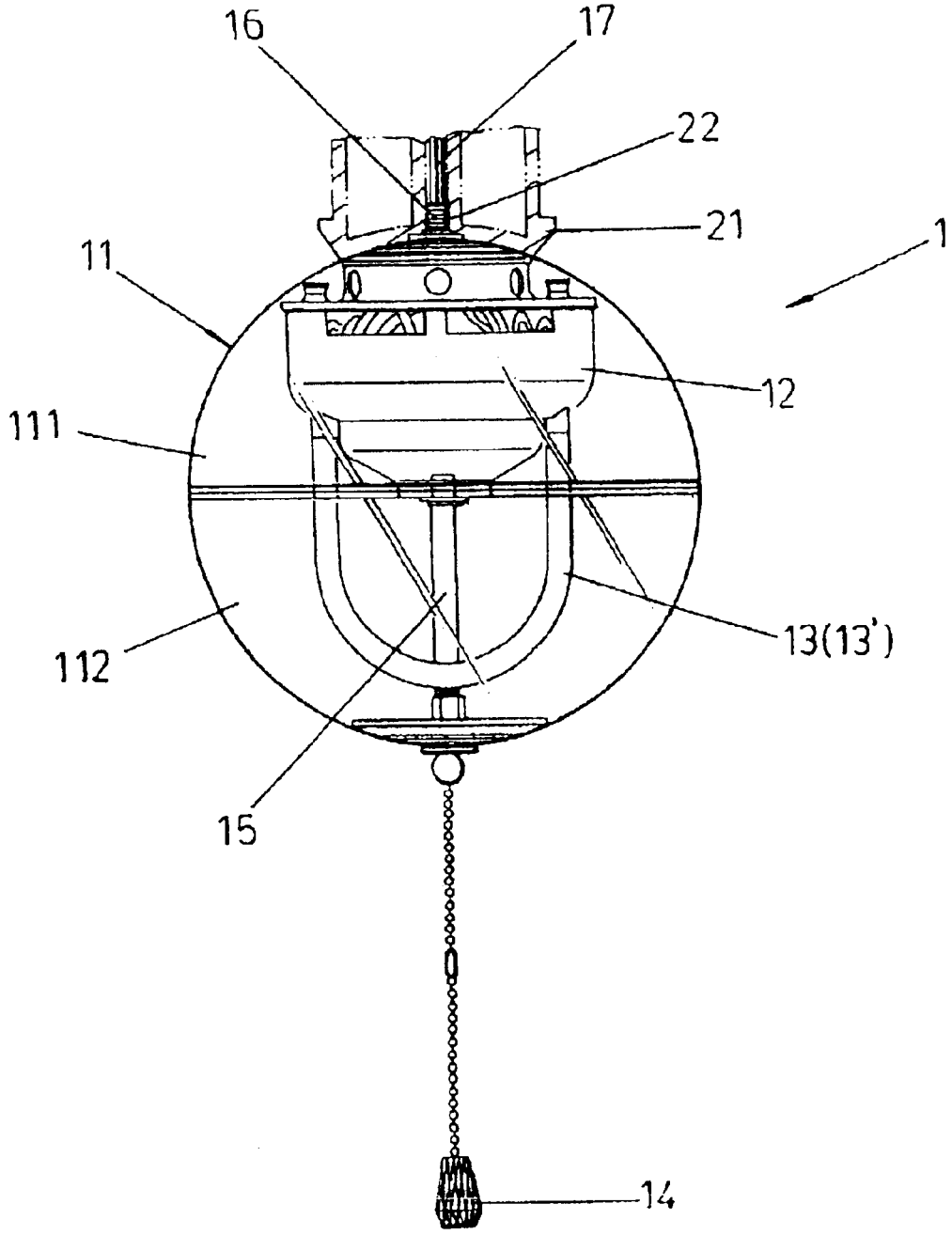
FIG. 4 is a cross-sectional view of the light fixture and the light fixture seat combination according to the present invention.
Figure 5:
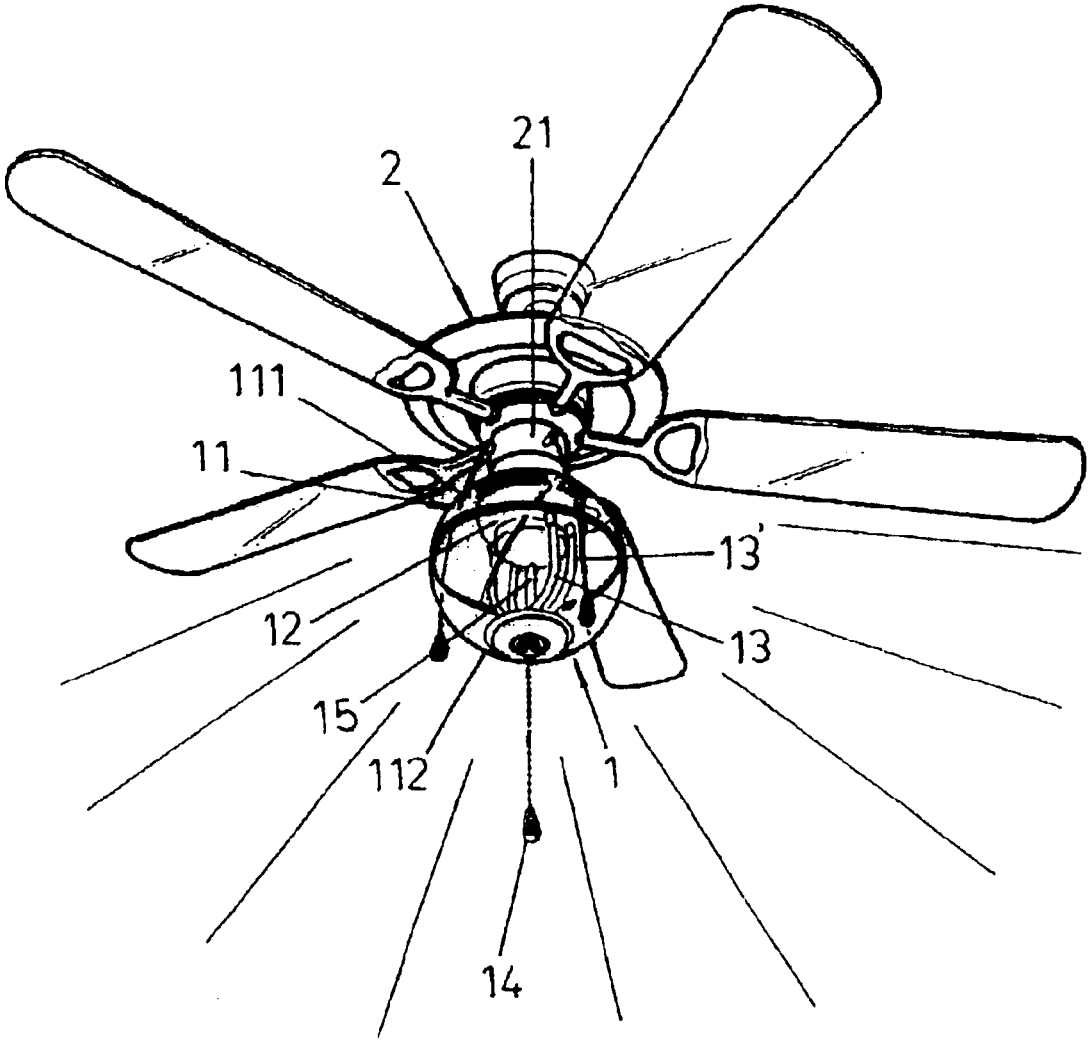
FIG. 5 is a perspective view of a preferred embodiment of the present invention.

Referring to FIGS. 2, 3 and 4, the present invention includes a ceiling fan (2) and a light fixture (1), underneath the ceiling fan is a seat body (21) with a screw hole (22) whereby a hollow screw (16) is to anchor the installation of the light fixture (1) or a modification thereof, depending on the occasion or personal preference.

The light fixture (1) is connected through a wire (17) of the hollow screw (16) and the screw hole (22) at the center of the seat body (21) to a power source. The light fixture (1) is itself devised with a hollow conduit (15) and a fixture base (12) for neon tubes (13) (13') while the neon tubes (13) and (13') are of different colors, for instances light pink and blue. The hollow conduits (15) houses wiring for a sectional switch (14) that controls neon tubes (13) and (13'). Pulling the sectional switch (14) once turns on the pink neon tube (13) while a second pull will turn on the blue neon tube instead; a third pull turns on both tubes simultaneously; versatile controls such as these are more pleasing to the contemporary market taste. A shell case (11) of the light fixture (1) is devised to facilitate constructing and dismantling of the assembly, comprises of an upper shell (111) and a lower shell (112). Removing either part makes it possible to maintain or to replace the neon tubes (13), (13') or the fixture base (12). The upper/lower shell (111), (112) can make alternative changes (from clear glass finish to sandblasted finish, for instance) or be substituted with a different part to affect a totally different look for the annex lighting fixture (1).

Figure 6:
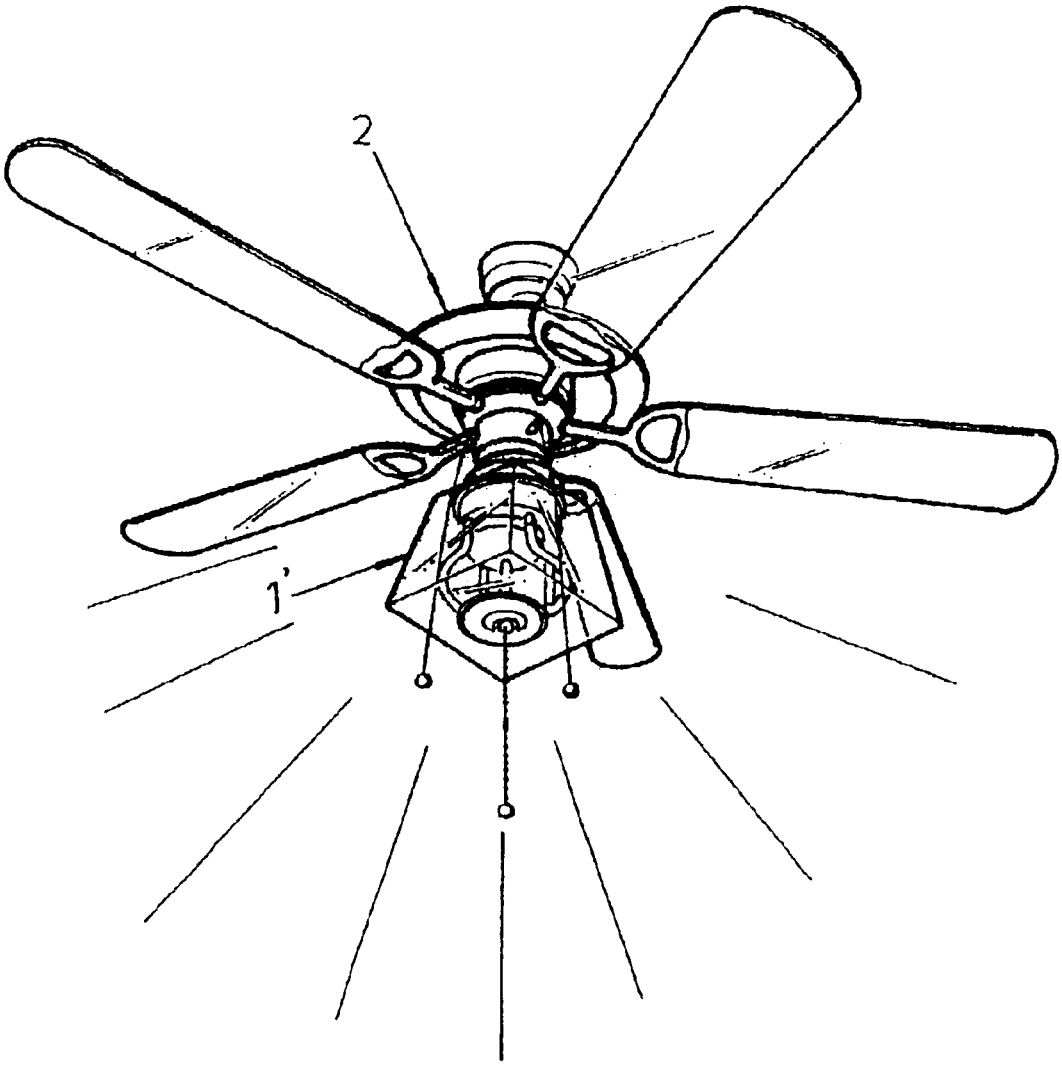
FIG. 6 is a perspective view of another preferred embodiment of the present invention.

Referring to FIG. 6 for another preferred embodiment of the present invention wherein the light fixture (1) is changed from a spherical shape into a polygon shape (1'), of course these are only two is examples of the rich variety that can be affected. Other shapes such as ellipse, cone, cylinder and etcetera, are all easily adopted.

To summarize, the present invention is not only capable of changing light color and atmosphere by switch-controlling the neon tubes (13), (13') to accommodate the atmosphere and occasion, neon tubes (13), (13') can be changed or replaced according to user preference. The change of the neon tubes (13) (13') is independent of the shell case (11) geometry while upper/lower shell (111) (112) is to be changed individually or collectively from clear finish to sandblast finish according to user preference.

It is of course to be understood that the embodiment described herein is merely illustrative of the principles of the invention and that a wide variety of the modifications thereto may be effected by persons skilled in the art without departing from the spirit and scope of the invention as set forth in the following claims.

What is claimed is:

1. An annex lighting fixture for a decorative ceiling fan comprising:

a ceiling fan, a light fixture having a fixture base where the light fixture is installed underneath the ceiling fan, wherein said light fixture has a sectional switch; a top of the light fixture has a hollow screw connected to a screw hole on a center of a seat body of the ceiling fan; the fixture base has a plurality of neon tubes installed thereon; a hollow conduit is connected to a center of the fixture base and houses wiring for the sectional switch; and a shell case that encloses the fixture base and neon tubes includes detachable upper and lower shells, wherein the shell case is of clear glazing finish.

2. An annex lighting fixture for a decorative ceiling fan comprising:

a) a ceiling fan having a seat body including a screw hole; and b) a light fixture connected to a bottom of the ceiling fan and having:

i) a light fixture and a sectional switch underneath said fixture base;

ii) a plurality of neon tubes connected to the fixture base;

iii) a hollow screw located on a top of the light fixture and connected to the screw hole of the seat body;

iv) a hollow conduit connected to a center of the fixture base and housing wiring for the sectional switch; and v) a shell case having detachable upper and lower shells, the fixture base and the neon tubes being located between the upper and lower shells.

3. The annex lighting fixture according to claim 2, wherein the shell case has a clear glazing finish.

4. The annex lighting fixture according to claim 2, wherein the shell case has a spherical shape.

5. The annex lighting fixture according to claim 2, wherein the shell case has a polygon shape.

* * * * *